US005472373A

United States Patent [19]

Wolters

[11] Patent Number: 5,472,373

[45] Date of Patent: Dec. 5, 1995

[54] DISK-GRINDING APPARATUS

[75] Inventor: Martin Wolters, Wuppertal, Germany

[73] Assignee: Ernst Thielenhaus KG, Wuppertal, Germany

[21] Appl. No.: 291,583

[22] Filed: Aug. 15, 1994

[30] Foreign Application Priority Data

Aug. 28, 1993 [DE] Germany ..... 43 28 985.1

[51] Int. Cl.[6] ..... B24B 7/00

[52] U.S. Cl. ..... 451/259; 451/342; 451/267

[58] Field of Search ..... 451/342, 360, 451/363, 430, 340, 290, 276, 277, 242, 269, 259, 63

[56] References Cited

U.S. PATENT DOCUMENTS

| | | | |
|---|---|---|---|
| 2,716,312 | 8/1955 | Speicher | 451/342 |
| 2,883,805 | 2/1958 | Limbers | 451/342 |
| 3,053,063 | 9/1962 | Ulleberg | 451/342 |
| 3,456,401 | 7/1969 | Kushmuk . | |
| 3,500,589 | 3/1970 | Ellege | 451/290 |
| 4,361,988 | 12/1982 | Gramlich | 451/63 |
| 4,766,702 | 8/1988 | Kinner | 451/63 |
| 4,825,596 | 5/1989 | Kinner | 451/63 |
| 4,827,677 | 5/1989 | Schmitz | 451/63 |
| 5,040,338 | 8/1991 | Schwär | 451/269 |
| 5,056,266 | 10/1991 | Norris | 451/290 |
| 5,133,155 | 7/1992 | Schwär | 451/269 |
| 5,381,630 | 1/1995 | Kinner | 451/63 |

*Primary Examiner*—Bruce M. Kisliuk
*Assistant Examiner*—Derris Banks
*Attorney, Agent, or Firm*—Herbert Dubno; Andrew Wilford

[57] ABSTRACT

A grinding apparatus has a tool support radially offset from a workpiece axis, rotatable about a support axis radially offset from and substantially parallel to the workpiece axis, and having a forwardly axially directed front support face formed at the support axis with an axially forwardly projecting centering formation formed a forwardly convex and part-spherical end surface. An annular grinding tool centered on a tool axis has an annular axially forwardly directed grinding surface engaging the workpiece surface and an axially backwardly directed rear tool face axially confronting the front support face and formed centered on the tool axis with an axially backwardly open recess engaging the end surface of the projection and of part-spherical shape complementary to the projection end surface. This tool is spaced from and out of direct contact with the support except at the recess and projection end surface. The support is rotated about the support axis with the grinding surface engaging the workpiece surface and projecting radially outwardly past the workpiece surface. An elastically compressible rear body is directly engaged between the rear tool face and front support face offset from the formation and recess. The tool is pressed axially backward to compress the body between the rear tool face and front support face for limited rocking of the tool axis relative to the support axis.

8 Claims, 3 Drawing Sheets

DISK-GRINDING APPARATUS

FIELD OF THE INVENTION

The present invention relates to an apparatus for grinding a flat annular surface of a workpiece. More particularly this invention concerns an apparatus for finish grinding a brake disk.

BACKGROUND OF THE INVENTION

A brake disk has an annular rim projecting radially outward from a cylindrical cup-shaped hub and having a pair of axially opposite annular faces that lie in respective parallel planes perpendicular to the symmetry axis of the disk. Such a disk is cast of metal and is given its finished shape by rotating it about its axis on a lathe-like machine that cuts the critical hub and rim faces. Since this material-removing roughing operation scores the rim faces, such a roughed workpiece must subsequently be finished by grinding at least its rim faces.

The standard procedure for finish grinding is to clamp the hub of the roughed disk and rotate the disk about its axis while urging a grinding stone axially against each rim face. Although such a procedure should in theory produce a perfectly planar finish in the brake disk, in reality the results are less than satisfactory. Invariably the rotation axis of the disk moves a little, for instance due to worn bearings supporting the disk-holding chuck, so that the resultant surface can be somewhat wavy and nonplanar.

As described in U.S. Pat. No. 3,456,401 of Kushmuk it is known to grind the faces of a metallic workpiece, in particular of a brake disk, by rotating the disk about its axis and urging against each of its faces a grinding stone that in turn is rotated about an axis at least generally parallel to the disk-rotation axis. According to this patent the grinding stone is both rotated about an axis that is parallel to the disk axis, but it is mounted on a universal joint so that it can rock somewhat with respect to its rotation axis and thereby follow the surface being ground. A spring braced across the joint urges the grinding disk into a position centered on an axis parallel to that of the disk, while permitting the above-mentioned rocking.

More specifically in the Kushmuk patent the grinding stone has a sleeve-like hub that fits over a grinding-tool drive shaft that rotates about its own axis that extends parallel to the disk axis. This hub has a ring with a universal-joint formation that engages the back of the grinding tool. The tool itself has two diametrally opposite pins extending orthogonal to the grinding-tool axis and that are engaged in slots in the sleeve-like hub. In this manner during grinding the spring presses the grinding tool against the disk face while the pins rotationally entrain the tool. The pins, however, inhibit the desired swiveling action of the universal-joint formations so that the resultant finish is not completely satisfactory. The loose fit can lead to uncontrolled vibration that produces a wavy finish in the brake disk.

OBJECTS OF THE INVENTION

It is therefore an object of the present invention to provide an improved grinding apparatus, in particular for finish-grinding a brake disk.

Another object is the provision of such an improved grinding apparatus, in particular for finish-grinding a brake disk which overcomes the above-given disadvantages, that is which produces a smooth finish and that is fairly simple in construction.

SUMMARY OF THE INVENTION

According to the invention a metallic workpiece centered on and rotating about an axis has an annular surface also centered on the axis and lying generally in a plane perpendicular to the axis. A grinding apparatus has a tool support radially offset from the workpiece axis, rotatable about a support axis radially offset from and substantially parallel to the workpiece axis, and having a forwardly axially directed front support face formed at the support axis with an axially forwardly projecting centering formation formed centered on the axis with a forwardly convex and part-spherical end surface having a center of curvature on the support axis. An annular grinding tool centered on a tool axis has an annular axially forwardly directed grinding surface engaging the workpiece surface and an axially backwardly directed rear tool face axially confronting the front support face and formed centered on the tool axis with an axially backwardly open recess engaging the end surface of the projection and of part-spherical shape complementary to the projection end surface with a center of curvature on the tool axis. This tool is spaced from and out of direct contact with the support except at the recess and projection end surface. The support is rotated about the support axis with the grinding surface engaging the workpiece surface and projecting radially outwardly past the workpiece surface. An elastically compressible rear body is directly engaged between the rear tool face and front support face offset from the formation and recess. The tool is pressed axially backward to compress the body between the rear tool face and front support face for limited rocking of the tool axis relative to the support axis about a point corresponding to the centers of curvature of the projection end surface and recess.

Thus the instant invention works without a universal joint. The invention is based on the surprising discovery that it is possible to finish grind something and produce an extremely smooth surface when the grinding stone is held in a simple elastically deformable mount, not in by a complex mechanical joint so long as it pivots about a point on the support axis. The tool surface can deflect in any direction to follow the surface it is smoothing and thus automatically produces a fine finish, without adding any irregularities to the workpiece surface. The tool is not constrained in any direction, as is the case when it is mounted by a knuckle-type or universal joint. In fact a frusto-conical surface can easily be finish machined with the system of this invention. The deflection is small, so that the actual gap or space between the tool and the support can also be very small, since the deviations are in the micron range.

According to another feature of the invention the tool has a forwardly directed face. An elastically compressible front body directly engaged against the front tool face is pressed axially backward against the front tool face. The tool can be cup-shaped and have a rim forming the grinding surface and a base formed with the recess. A flat rigid disk bearing axially backward against the body can press it backward. A bolt threaded in the projection has a head bearing axially backward on the disk. The rear body itself can be a flat elastomeric washer and the front body a flat elastomeric disk. The projection on which the tool rocks is substantially cylindrical and centered on the support axis.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
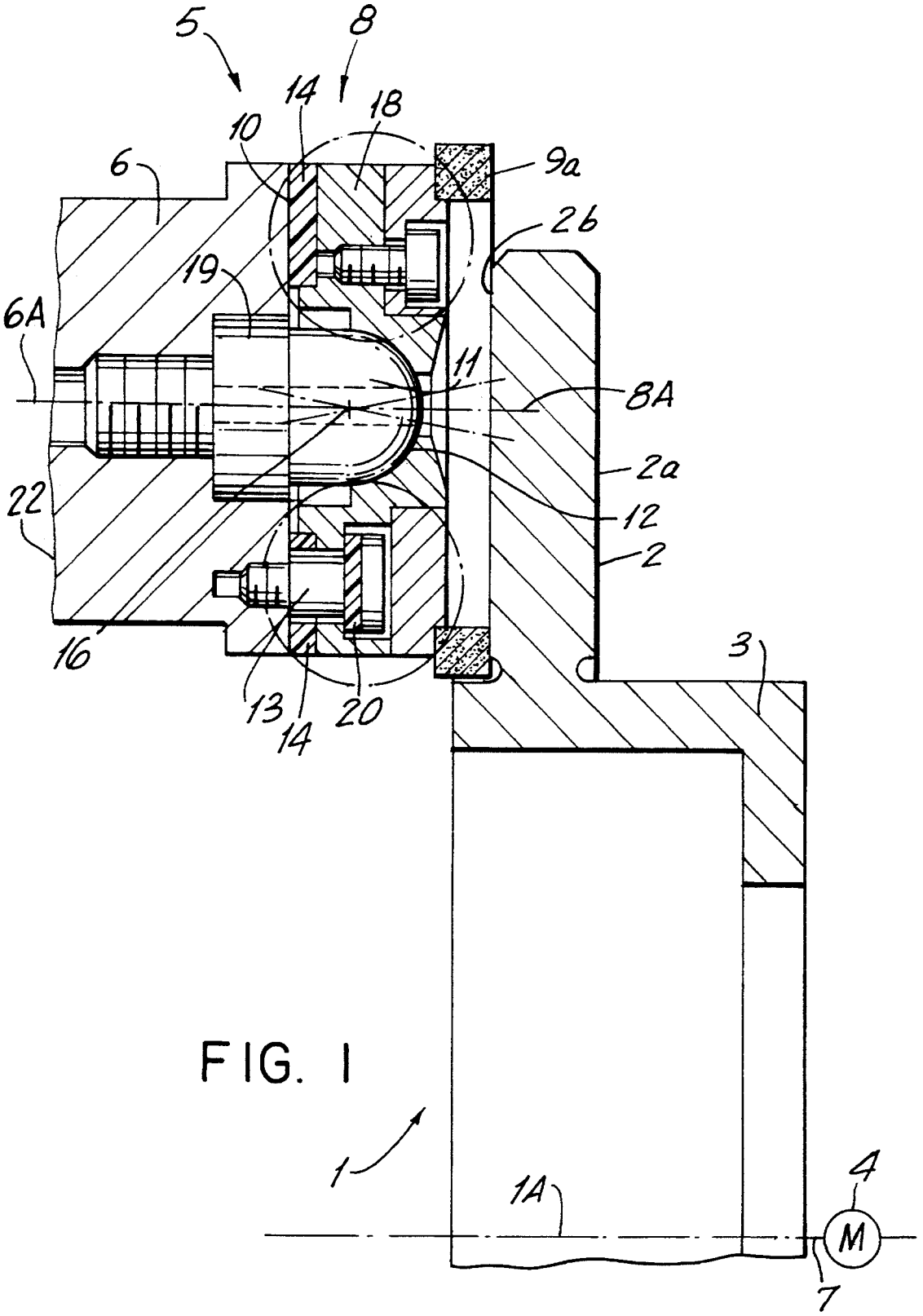
FIG. 1 is a partly diagrammatic axial section through the grinding apparatus according to the invention.
Figure 2:
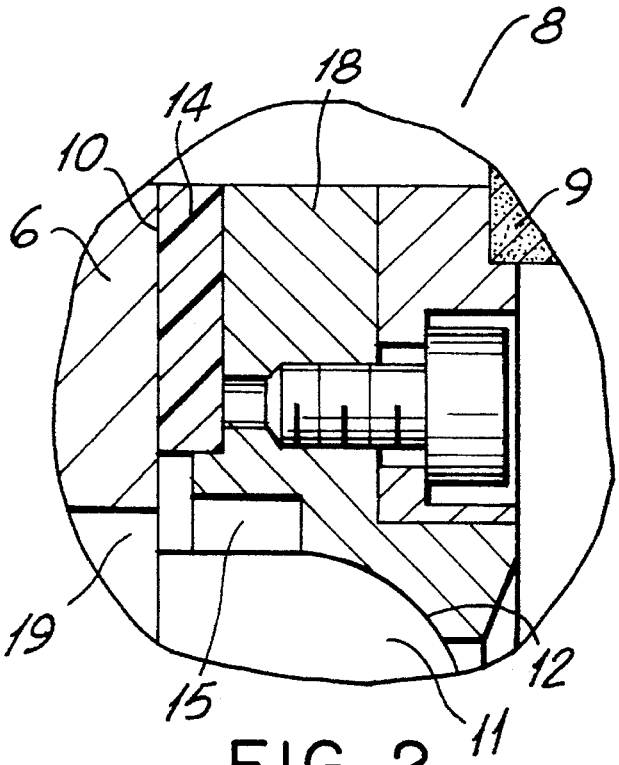
FIGS. 2 and 3 are large-scale views of the details indicated respectively at II and III of FIG. 1.
Figure 3:
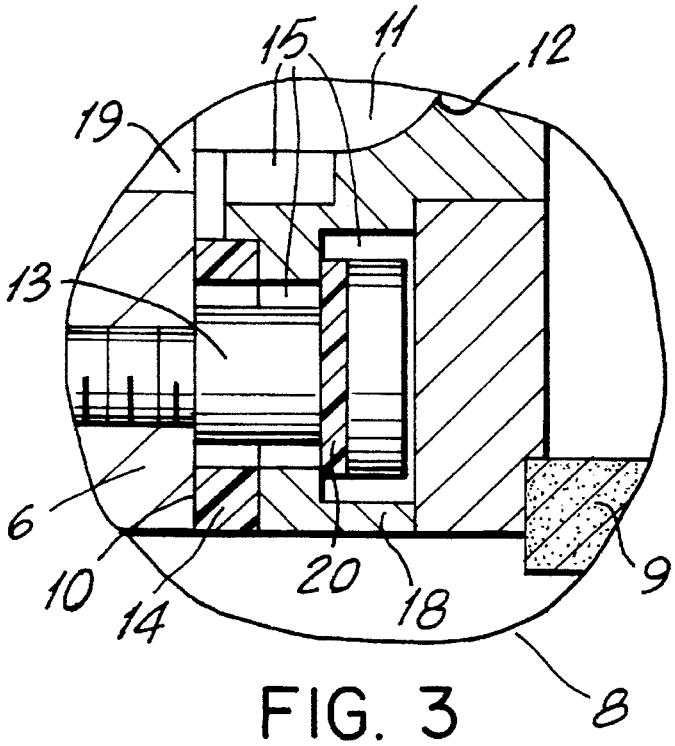

As seen in FIGS. 1 through 3 a rough-machined brake disk 1 has a hub 3 and a rim or disk 2 and is centered on an axis 1A. A motor indicated schematically at 4 normally rotates this cast-aluminum workpiece about the axis 1A. The disk 2 has axially oppositely directed annular front and back faces 2*a* and 2*b*.

A grinding-tool assembly 5 has a shaft 6 centered on an axis 6A parallel to but offset from the axis 1A and rotated about this axis 6A by a drive indicated schematically at 22. This support shaft 6 has a front face 10 lying in a plane perpendicular to the axis 6A and is provided with an insert 19 having a front end projecting from the surface 10 and having a semi spherical end surface 11 centered on a point 16 lying on the axis 6A.

The support shaft 6 carries a tool 8 provided on its front end with an annular grinding stone 9 having a planar front face 9*a* that is pressed axially forwardly against the disk face 2*b*. This tool 8 is centered on a tool axis 8A that here is coaxial with the axis 6A. The stone 9 is carried on an annular body 18 having a rear face 7 perpendicular to the axis 8A and axially confronting the face 10 of the shaft 6. An elastomeric washer 14 is compressed between the faces 7 and 8. Three angularly equispaced bolts 13 seated in the shaft 6 extend axially forward through the body 18 and have heads that bear axially backward via respective washers 20 on the body 18. The tool 8 is centrally formed with a part-spherical seat or recess 12 that complementarily receives the surface 10 and that has a center of curvature that coincides with that of the surface 11. Thus this tool 8 directly engages the support 6 at the surface 11 but everywhere else forms spaces 15 therewith.

Figure 4:
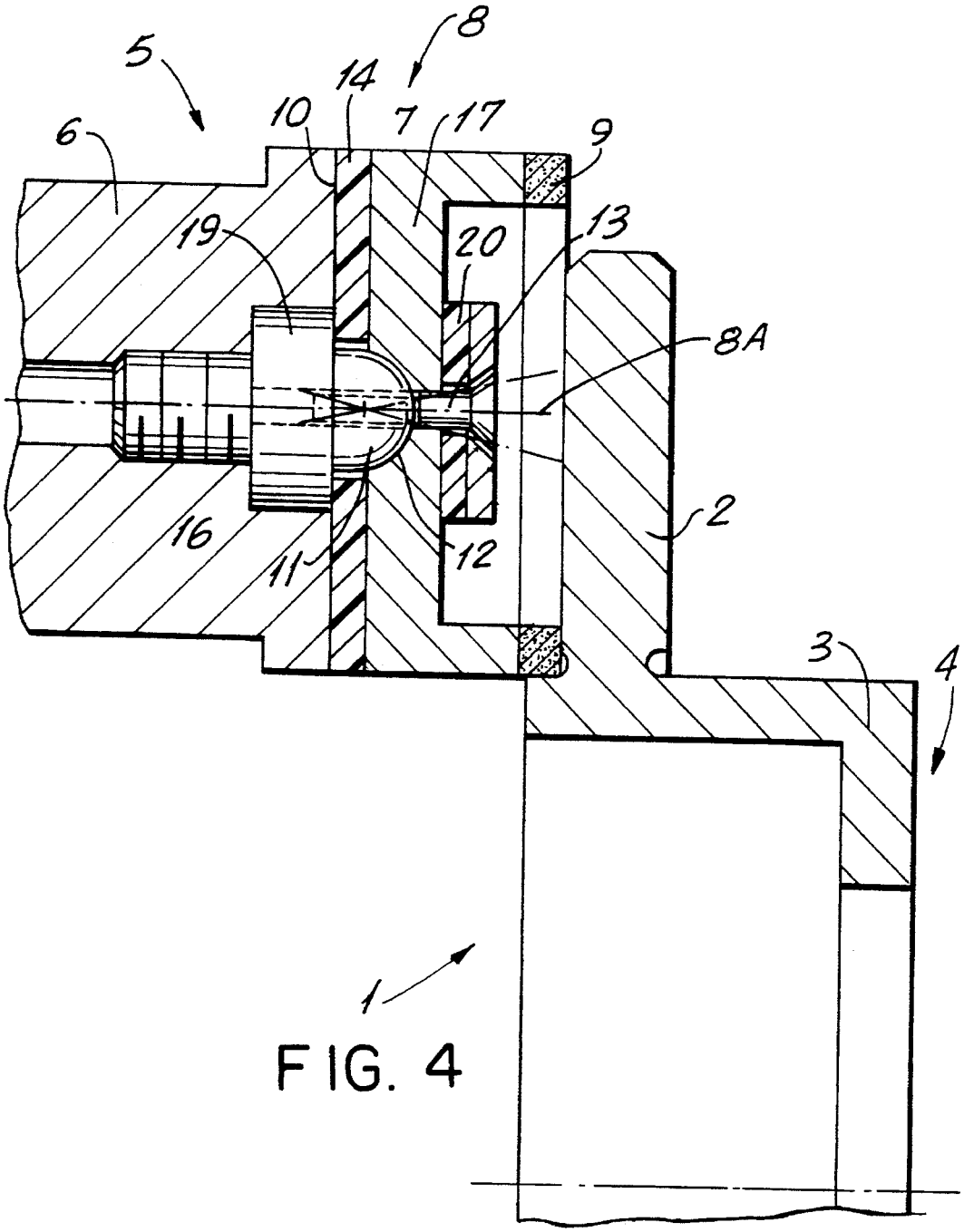
FIG. 4 is a view like FIG. 1 of another apparatus according to the invention.

In the arrangement of FIG. 4 there is only one screw 13' and it is screwed on the axis 8A into the center of the surface 11 of the insert 10. A single elastomeric washer 20' around the bolt 13' bears against a front face of a one-part tool body 17 that is basically cup-shaped.

In both systems it is possible for the tool 8 to tip about the centers 16 as it rides on the surface 2*b*. The diameter of the stone 9 is substantially greater than the radial width dimension of the surface 2*b* so that the tool 9 projects radially outward past the disk 2 and therefore self-sharpens as it leaves and regains contact with this surface 2*b*.

I claim:

1. An apparatus for grinding a metallic workpiece centered on and rotating about an axis and having an annular surface also centered on the axis and lying generally in a plane perpendicular to the axis, the apparatus comprising:

a tool support radially offset from the workpiece axis, rotatable about a support axis radially offset from and substantially parallel to the workpiece axis, and having a forwardly axially directed front support face formed at the support axis with an axially forwardly projecting centering formation formed centered on the axis with a forwardly convex and part-spherical end surface having a center of curvature on the support axis;

an annular grinding tool centered on a tool axis and having an annular axially forwardly directed grinding surface engaging the workpiece surface and an axially backwardly directed rear tool face axially confronting the front support face and formed centered on the tool axis with an axially backwardly open recess engaging the end surface of the projection and of part-spherical shape complementary to the projection end surface with a center of curvature on the tool axis, the tool being spaced from and out of direct contact with the support except at the recess and projection end surface;

means for rotating the support about the support axis with the grinding surface engaging the workpiece surface and projecting radially outwardly past the workpiece surface;

an elastically compressible rear body directly engaged between the rear tool face and front support face offset from the formation and recess; and means secured in the tool for pressing the tool axially backward and thereby compressing the body between the rear tool face and front support face for limited rocking of the tool axis relative to the support axis about a point corresponding to the centers of curvature of the projection end surface and recess.

2. The grinding apparatus defined in claim 1 wherein the tool has a forwardly directed face, the apparatus further comprising:

an elastically compressible front body directly engaged against the front tool face; and means secured to the support for pressing the front body axially backward against the front tool face.

3. The grinding apparatus defined in claim 2 wherein the tool is cup-shaped and has a rim forming the grinding surface and a base formed with the recess.

4. The grinding apparatus defined in claim 1 wherein the pressing means includes a flat rigid disk bearing axially backward against the body.

5. The grinding apparatus defined in claim 1 wherein the pressing means includes a bolt threaded in the projection and having a head bearing axially backward on the disk.

6. The grinding apparatus defined in claim 1 wherein the rear body is a flat elastomeric washer.

7. The grinding apparatus defined in claim 1 wherein the front body is a flat elastomeric disk.

8. The grinding apparatus defined in claim 1 wherein the projection is substantially cylindrical and centered on the support axis.

* * * * *